US010495098B2

(12) United States Patent
Preuss et al.

(10) Patent No.: US 10,495,098 B2
(45) Date of Patent: Dec. 3, 2019

(54) SYSTEMS AND METHODS FOR BALANCING THRUST LOADS IN A HEAT ENGINE SYSTEM

(71) Applicant: ECHOGEN POWER SYSTEMS LLC, Akron, OH (US)

(72) Inventors: Jason Lee Preuss, Lakewood, CO (US); Timothy J. Held, Akron, OH (US)

(73) Assignee: ECHOGEN POWER SYSTEMS LLC, Akron, OH (US)

( * ) Notice: Subject to any disclaimer, the term of this patent is extended or adjusted under 35 U.S.C. 154(b) by 247 days.

(21) Appl. No.: 15/307,052

(22) PCT Filed: Jun. 12, 2015

(86) PCT No.: PCT/US2015/035567
§ 371 (c)(1),
(2) Date: Oct. 27, 2016

(87) PCT Pub. No.: WO2015/192005
PCT Pub. Date: Dec. 17, 2015

(65) Prior Publication Data

US 2017/0191482 A1 Jul. 6, 2017

Related U.S. Application Data

(60) Provisional application No. 62/011,678, filed on Jun. 13, 2014.

(51) Int. Cl.
*F04D 29/051* (2006.01)
*F04D 29/041* (2006.01)
(Continued)

(52) U.S. Cl.
CPC ..... *F04D 29/0513* (2013.01); *F01D 3/00* (2013.01); *F01K 7/16* (2013.01); *F01K 13/00* (2013.01);
(Continued)

(58) Field of Classification Search
CPC ..... F04D 13/043; F04D 13/046; F04D 13/04; F04D 25/04; F04D 29/041; F04D 29/0413; F04D 29/051; F04D 29/0513
See application file for complete search history.

(56) References Cited

U.S. PATENT DOCUMENTS 3,677,659 A 7/1972 Williams
3,828,610 A 8/1974 Swearingen
(Continued)

FOREIGN PATENT DOCUMENTS

JP 2004108220 A 4/2004

OTHER PUBLICATIONS

PCT International Search Report and Written Opinion dated Sep. 21, 2015 corresponding to PCT Application PCT/US2015/035567 filed Jun. 12, 2015. (12 pages).

*Primary Examiner* — Bryan M Lettman

(57) ABSTRACT

A turbopump system includes a pump portion including a housing having a pressure release passageway disposed therein. The pump portion is disposed between a high pressure side and a low pressure side of a working fluid circuit. A drive turbine is coupled to the pump portion and configured to drive the pump portion to enable the pump portion to circulate a working fluid through the working fluid circuit. A pressure release valve is fluidly coupled to the pressure release passageway and configured to be positioned in an opened position to enable pressure to be released
(Continued)

through the pressure release passageway and in a closed position to disable pressure from being released through the pressure release passageway.

3 Claims, 4 Drawing Sheets

(51) Int. Cl.

| | |
|---|---|
| ***F04D 13/04*** | (2006.01) |
| ***F04D 15/00*** | (2006.01) |
| ***F01K 7/16*** | (2006.01) |
| ***F01D 3/00*** | (2006.01) |
| ***F01K 13/00*** | (2006.01) |
| ***F04D 29/66*** | (2006.01) |

(52) U.S. Cl.
CPC ..... *F04D 13/043* (2013.01); *F04D 15/0083* (2013.01); *F04D 29/041* (2013.01); *F04D 29/0413* (2013.01); *F04D 29/66* (2013.01)

(56) References Cited

U.S. PATENT DOCUMENTS 3,895,689 A * 7/1975 Swearingen ..... F01D 25/168 184/6.4
4,170,435 A 10/1979 Swearingen
4,385,768 A * 5/1983 Swearingen ..... F16C 17/26 277/321
4,884,942 A * 12/1989 Pennink ..... F16C 32/0692 415/104
2004/0247211 A1 12/2004 Hamke
2006/0225421 A1 10/2006 Yamanaka et al.
2007/0292283 A1 12/2007 Oklejas
2008/0095610 A1* 4/2008 Bosen ..... F01D 3/04 415/104
2012/0131919 A1* 5/2012 Held ..... F01K 13/02 60/646
2012/0177476 A1* 7/2012 Jones ..... F02B 39/14 415/1
2013/0036736 A1 2/2013 Hart et al.
2014/0096521 A1 4/2014 Held et al.

* cited by examiner

SYSTEMS AND METHODS FOR BALANCING THRUST LOADS IN A HEAT ENGINE SYSTEM

CROSS REFERENCE TO RELATED APPLICATIONS

This application claims priority to U.S. Provisional Patent Application having Ser. No. 62/011,678, which was filed Jun. 13, 2014. The aforementioned patent application is hereby incorporated by reference in its entirety into the present application to the extent consistent with the present application.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles. Rankine cycles and similar thermodynamic methods are typically steam-based processes that recover and utilize waste heat to generate steam for driving a turbine, turbo, or other expander connected to an electric generator or pump. An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbons, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

The heat engine systems often utilize a turbopump to circulate the working fluid that captures the waste heat. The turbopump, as well as other rotating equipment used in the systems, typically generates thrust loads that arise from the operating pressures and fluid momentum changes that occur in the system during operation. The turbopump may have operational limitations set or determined by a maximum thrust load that may be applied thereto before the turbopump and/or components thereof become damaged. In high density machinery operating with supercritical fluids, such as supercritical carbon dioxide, the machine power density, pressure rise, and rotating speeds exceed those of standard systems, increasing the likelihood of system damage due to excessive thrust loads and rendering standard thrust bearing design techniques inadequate. Accordingly, in some prior high density machinery, a thrust balance piston technique has been employed. However, such techniques have been found to negatively impact system efficiency.

Therefore, there is a need for systems and methods for balancing the thrust loads present in a heat engine system while overcoming the drawbacks of traditional approaches.

SUMMARY

In one embodiment, a turbopump system includes a pump portion including a housing having a pressure release passageway disposed therein. The pump portion is disposed between a high pressure side and a low pressure side of a working fluid circuit. A drive turbine is coupled to the pump portion and configured to drive the pump portion to enable the pump portion to circulate a working fluid through the working fluid circuit. A pressure release valve is fluidly coupled to the pressure release passageway and configured to be positioned in an opened position to enable pressure to be released through the pressure release passageway and in a closed position to disable pressure from being released through the pressure release passageway.

In another embodiment, a turbopump system includes a pump disposed between a high pressure side and a low pressure side of a working fluid circuit and configured to circulate a working fluid through the working fluid circuit. A pressure release passageway is integrally formed in a housing of the pump and configured to enable release of pressure from the pump. A pressure release valve is fluidly coupled to the pressure release passageway and configured to be positioned in an opened position to enable pressure to be released through the pressure release passageway and in a closed position to disable pressure from being released through the pressure release passageway.

In another embodiment, a thrust balancing method for a turbopump assembly includes receiving first data corresponding to a measured pressure at an inlet of a pump configured to circulate a working fluid through a working fluid circuit, receiving second data corresponding to a measured pressure at an outlet of the pump, and receiving third data corresponding to a measured pressure at a pressure release passageway disposed in a back side of the pump. The method also includes determining, based on the first data, the second data, the third data, or a combination thereof, whether a thrust load generated by the pump exceeds a predetermined threshold, and actuating, using a control circuit, a pressure release valve fluidly coupled to the pressure release passageway to an opened position to release pressure from the pump when the thrust load exceeds the predetermined threshold.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

As described in more detail below, presently disclosed embodiments are directed to systems and methods for efficiently transforming thermal energy of a heat stream (e.g., a waste heat stream) into valuable electrical energy. The provided embodiments enable the reduction or prevention of damage to components of the heat engine system due to thrust load imbalances. For example, in some embodiments, a heat engine system is configured to maintain a working fluid (e.g., sc-$CO_2$) within the low pressure side of a working fluid circuit in a liquid-type state, such as a supercritical state, during some or all of the operational period of the working fluid circuit. In such embodiments, the pressure increases that arise with increasing pump speeds may lead to thrust load imbalances that may be reduced or eliminated by one or more features of presently disclosed embodiments. For example, certain embodiments may include a pressure release passageway and/or a pressure release valve capable of enabling the selective release of pressure from a pump to balance one or more thrust loads. These and other features of presently disclosed embodiments are discussed in more detail below.

Figure 1:
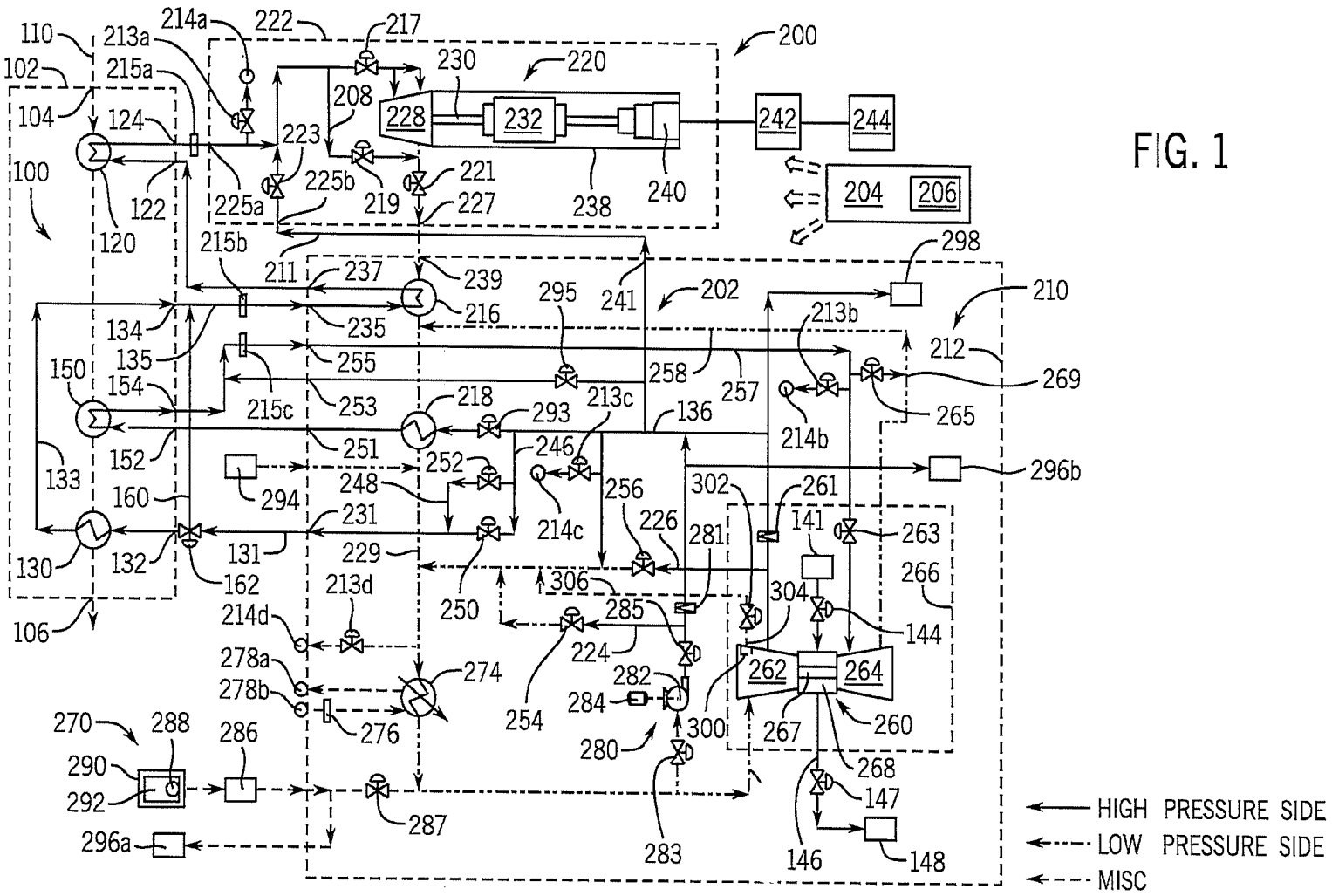
FIG. 1 illustrates an embodiment of a heat engine system, according to one or more embodiments disclosed herein.

Turning now to the drawings, FIG. 1 illustrates an embodiment of a heat engine system 200, which may also be referred to as a thermal engine system, an electrical generation system, a waste heat or other heat recovery system, and/or a thermal to electrical energy system, as described in one or more embodiments below. The heat engine system 200 is generally configured to encompass one or more elements of a Rankine cycle, a derivative of a Rankine cycle, or another thermodynamic cycle for generating electrical energy from a wide range of thermal sources. The heat engine system 200 includes a waste heat system 100 and a power generation system 220 coupled to and in thermal communication with each other via a working fluid circuit 202 disposed within a process system 210. During operation, a working fluid, such as supercritical carbon dioxide (sc-$CO_2$), is circulated through the working fluid circuit 202, and heat is transferred to the working fluid from a heat source stream 110 flowing through the waste heat system 100. Once heated, the working fluid is circulated through a power turbine 228 within the power generation system 220 where the thermal energy contained in the heated working fluid is converted to mechanical energy. In this way, the process system 210, the waste heat system 100, and the power generation system 220 cooperate to convert the thermal energy in the heat source stream 110 into mechanical energy, which may be further converted into electrical energy if desired, depending on implementation-specific considerations.

More specifically, in the embodiment of FIG. 1, the waste heat system 100 contains three heat exchangers (i.e., the heat exchangers 120, 130, and 150) fluidly coupled to a high pressure side of the working fluid circuit 202 and in thermal communication with the heat source stream 110. Such thermal communication provides the transfer of thermal energy from the heat source stream 110 to the working fluid flowing throughout the working fluid circuit 202. In one or more embodiments disclosed herein, two, three, or more heat exchangers may be fluidly coupled to and in thermal communication with the working fluid circuit 202, such as a primary heat exchanger, a secondary heat exchanger, a tertiary heat exchanger, respectively the heat exchangers 120, 150, and 130. For example, the heat exchanger 120 may be the primary heat exchanger fluidly coupled to the working fluid circuit 202 upstream of an inlet of the power turbine 228, the heat exchanger 150 may be the secondary heat exchanger fluidly coupled to the working fluid circuit 202 upstream of an inlet of the drive turbine 264 of the turbine pump 260, and the heat exchanger 130 may be the tertiary heat exchanger fluidly coupled to the working fluid circuit 202 upstream of an inlet of the heat exchanger 120. However, it should be noted that in other embodiments, any desired number of heat exchangers, not limited to three, may be provided in the waste heat system 100.

Further, the waste heat system 100 also contains an inlet 104 for receiving the heat source stream 110 and an outlet 106 for passing the heat source stream 110 out of the waste heat system 100. The heat source stream 110 flows through and from the inlet 104, through the heat exchanger 120, through one or more additional heat exchangers, if fluidly coupled to the heat source stream 110, and to and through the outlet 106. In some examples, the heat source stream 110 flows through and from the inlet 104, through the heat exchangers 120, 150, and 130, respectively, and to and through the outlet 106. The heat source stream 110 may be routed to flow through the heat exchangers 120, 130, 150, and/or additional heat exchangers in other desired orders.

In some embodiments described herein, the waste heat system 100 is disposed on or in a waste heat skid 102 fluidly coupled to the working fluid circuit 202, as well as other portions, sub-systems, or devices of the heat engine system 200. The waste heat skid 102 may be fluidly coupled to a source of and an exhaust for the heat source stream 110, a main process skid 212, a power generation skid 222, and/or other portions, sub-systems, or devices of the heat engine system 200.

In one or more configurations, the waste heat system 100 disposed on or in the waste heat skid 102 generally contains inlets 122, 132, and 152 and outlets 124, 134, and 154 fluidly coupled to and in thermal communication with the working fluid within the working fluid circuit 202. The inlet 122 is disposed upstream of the heat exchanger 120, and the outlet 124 is disposed downstream from the heat exchanger 120. The working fluid circuit 202 is configured to flow the working fluid from the inlet 122, through the heat exchanger 120, and to the outlet 124 while transferring thermal energy from the heat source stream 110 to the working fluid by the heat exchanger 120. The inlet 152 is disposed upstream of the heat exchanger 150, and the outlet 154 is disposed downstream from the heat exchanger 150. The working fluid circuit 202 is configured to flow the working fluid from the inlet 152, through the heat exchanger 150, and to the outlet 154 while transferring thermal energy from the heat source stream 110 to the working fluid by the heat exchanger 150. The inlet 132 is disposed upstream of the heat exchanger 130, and the outlet 134 is disposed downstream from the heat exchanger 130. The working fluid circuit 202 is configured to flow the working fluid from the inlet 132, through the heat exchanger 130, and to the outlet 134 while transferring thermal energy from the heat source stream 110 to the working fluid by the heat exchanger 130.

The heat source stream 110 that flows through the waste heat system 100 may be a waste heat stream such as, but not limited to, a gas turbine exhaust stream, an industrial process exhaust stream, or any other combustion product exhaust stream, such as a furnace or boiler exhaust stream. The heat source stream 110 may be at a temperature within a range from about 100° C. to about 1,000° C., or greater than 1,000°

C., and in some examples, within a range from about 200° C. to about 800° C., more narrowly within a range from about 300° C. to about 600° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

Turning now to the power generation system 220, the illustrated embodiment includes the power turbine 228 disposed between a high pressure side and a low pressure side of the working fluid circuit 202. The power turbine 228 is configured to convert thermal energy to mechanical energy by a pressure drop in the working fluid flowing between the high and the low pressure sides of the working fluid circuit 202. A power generator 240 is coupled to the power turbine 228 and configured to convert the mechanical energy into electrical energy. In certain embodiments, a power outlet 242 may be electrically coupled to the power generator 240 and configured to transfer the electrical energy from the power generator 240 to an electrical grid 244. The illustrated power generation system 220 also contains a driveshaft 230 and a gearbox 232 coupled between the power turbine 228 and the power generator 240.

In one or more configurations, the power generation system 220 is disposed on or in the power generation skid 222 that contains inlets 225*a*, 225*b* and an outlet 227 fluidly coupled to and in thermal communication with the working fluid within the working fluid circuit 202. The inlets 225*a*, 225*b* are upstream of the power turbine 228 within the high pressure side of the working fluid circuit 202 and are configured to receive the heated and high pressure working fluid. In some examples, the inlet 225*a* may be fluidly coupled to the outlet 124 of the waste heat system 100 and configured to receive the working fluid flowing from the heat exchanger 120. Further, the inlet 225*b* may be fluidly coupled to the outlet 241 of the process system 210 and configured to receive the working fluid flowing from the turbopump 260 and/or the start pump 280. The outlet 227 is disposed downstream from the power turbine 228 within the low pressure side of the working fluid circuit 202 and is configured to provide the low pressure working fluid. In some examples, the outlet 227 may be fluidly coupled to the inlet 239 of the process system 210 and configured to flow the working fluid to the recuperator 216.

A filter 215*a* may be disposed along and in fluid communication with the fluid line at a point downstream from the heat exchanger 120 and upstream of the power turbine 228. In some examples, the filter 215*a* is fluidly coupled to the working fluid circuit 202 between the outlet 124 of the waste heat system 100 and the inlet 225*a* of the process system 210.

Again, the portion of the working fluid circuit 202 within the power generation system 220 is fed the working fluid by the inlets 225*a* and 225*b*. Additionally, a power turbine stop valve 217 is fluidly coupled to the working fluid circuit 202 between the inlet 225*a* and the power turbine 228. The power turbine stop valve 217 is configured to control the working fluid flowing from the heat exchanger 120, through the inlet 225*a*, and into the power turbine 228 while in an opened position. Alternatively, the power turbine stop valve 217 may be configured to cease the flow of working fluid from entering into the power turbine 228 while in a closed position.

A power turbine attemperator valve 223 is fluidly coupled to the working fluid circuit 202 via an attemperator bypass line 211 disposed between the outlet on the pump portion 262 of the turbopump 260 and the inlet on the power turbine 228 and/or disposed between the outlet on the pump portion 282 of the start pump 280 and the inlet on the power turbine 228. The attemperator bypass line 211 and the power turbine attemperator valve 223 may be configured to flow the working fluid from the pump portion 262 or 282, around and avoid the recuperator 216 and the heat exchangers 120 and 130, and to the power turbine 228, such as during a warm-up or cool-down step. The attemperator bypass line 211 and the power turbine attemperator valve 223 may be utilized to warm the working fluid with heat coming from the power turbine 228 while avoiding the thermal heat from the heat source stream 110 flowing through the heat exchangers, such as the heat exchangers 120 and 130. In some examples, the power turbine attemperator valve 223 may be fluidly coupled to the working fluid circuit 202 between the inlet 225*b* and the power turbine stop valve 217 upstream of a point on the fluid line that intersects the incoming stream from the inlet 225*a*. The power turbine attemperator valve 223 may be configured to control the working fluid flowing from the start pump 280 and/or the turbopump 260, through the inlet 225*b*, and to a power turbine stop valve 217, the power turbine bypass valve 219, and/or the power turbine 228.

The power turbine bypass valve 219 is fluidly coupled to a turbine bypass line that extends from a point of the working fluid circuit 202 upstream of the power turbine stop valve 217 and downstream from the power turbine 228. Therefore, the bypass line and the power turbine bypass valve 219 are configured to direct the working fluid around and avoid the power turbine 228. If the power turbine stop valve 217 is in a closed position, the power turbine bypass valve 219 may be configured to flow the working fluid around and avoid the power turbine 228 while in an opened position. In one embodiment, the power turbine bypass valve 219 may be utilized while warming up the working fluid during a startup operation of the electricity generating process. An outlet valve 221 is fluidly coupled to the working fluid circuit 202 between the outlet on the power turbine 228 and the outlet 227 of the power generation system 220.

Turning now to the process system 210, in one or more configurations, the process system 210 is disposed on or in the main process skid 212 and includes inlets 235, 239, and 255 and outlets 231, 237, 241, 251, and 253 fluidly coupled to and in thermal communication with the working fluid within the working fluid circuit 202. The inlet 235 is upstream of the recuperator 216 and the outlet 154 is downstream from the recuperator 216. The working fluid circuit 202 is configured to flow the working fluid from the inlet 235, through the recuperator 216, and to the outlet 237 while transferring thermal energy from the working fluid in the low pressure side of the working fluid circuit 202 to the working fluid in the high pressure side of the working fluid circuit 202 by the recuperator 216. The outlet 241 of the process system 210 is downstream from the turbopump 260 and/or the start pump 280, upstream of the power turbine 228, and configured to provide a flow of the high pressure working fluid to the power generation system 220, such as to the power turbine 228. The inlet 239 is upstream of the recuperator 216, downstream from the power turbine 228, and configured to receive the low pressure working fluid flowing from the power generation system 220, such as to the power turbine 228. The outlet 251 of the process system 210 is downstream from the recuperator 218, upstream of the heat exchanger 150, and configured to provide a flow of working fluid to the heat exchanger 150. The inlet 255 is downstream from the heat exchanger 150, upstream of the drive turbine 264 of the turbopump 260, and configured to provide the heated high pressure working fluid flowing from the heat exchanger 150 to the drive turbine 264 of the turbopump 260. The outlet 253 of the process system 210 is downstream from the pump portion 262 of the turbopump 260 and/or the pump portion 282 of the start pump 280, couples a bypass line disposed downstream from the heat exchanger 150 and upstream of the drive turbine 264 of the turbopump 260, and is configured to provide a flow of working fluid to the drive turbine 264 of the turbopump 260.

Additionally, a filter 215*c* may be disposed along and in fluid communication with the fluid line at a point downstream from the heat exchanger 150 and upstream of the drive turbine 264 of the turbopump 260. In some examples, the filter 215*c* is fluidly coupled to the working fluid circuit 202 between the outlet 154 of the waste heat system 100 and the inlet 255 of the process system 210. Further, a filter 215*b* may be disposed along and in fluid communication with the fluid line 135 at a point downstream from the heat exchanger 130 and upstream of the recuperator 216. In some examples, the filter 215*b* is fluidly coupled to the working fluid circuit 202 between the outlet 134 of the waste heat system 100 and the inlet 235 of the process system 210.

In certain embodiments, as illustrated in FIG. 1, the process system 210 may be disposed on or in the main process skid 212, the power generation system 220 may be disposed on or in a power generation skid 222, and the waste heat system 100 may be disposed on or in a waste heat skid 102. In these embodiments, the working fluid circuit 202 extends throughout the inside, the outside, and between the main process skid 212, the power generation skid 222, and the waste heat skid 102, as well as other systems and portions of the heat engine system 200. Further, in some embodiments, the heat engine system 200 includes the heat exchanger bypass line 160 and the heat exchanger bypass valve 162 disposed between the waste heat skid 102 and the main process skid 212 for the purpose of routing the working fluid away from one or more of the heat exchangers during startup to reduce or eliminate component wear and/or damage.

Turning now to features of the working fluid circuit 202, the working fluid circuit 202 contains the working fluid (e.g., sc-$CO_2$) and has a high pressure side and a low pressure side. FIG. 1 depicts the high and low pressure sides of the working fluid circuit 202 of the heat engine system 200 by representing the high pressure side with "——" and the low pressure side with "-•-•-•"—as described in one or more embodiments. In certain embodiments, the working fluid circuit 202 includes one or more pumps, such as the illustrated turbopump 260 and start pump 280. The turbopump 260 and the start pump 280 are operative to pressurize and circulate the working fluid throughout the working fluid circuit 202 and may each be an assembly of components that form the turbopump 260 or the start pump 280.

The turbopump 260 may be a turbo-drive pump or a turbine-drive pump and, in some embodiments, may form a pump assembly having a pump portion 262 and a drive turbine 264 coupled together by a driveshaft 267 and an optional gearbox (not shown). The driveshaft 267 may be a single shaft or may contain two or more shafts coupled together. In one example, a first segment of the driveshaft 267 extends from the drive turbine 264 to the gearbox, a second segment of the driveshaft 230 extends from the gearbox to the pump portion 262, and multiple gears are disposed between and couple to the two segments of the driveshaft 267 within the gearbox.

The drive turbine 264 is configured to rotate the pump portion 262 and the pump portion 262 is configured to circulate the working fluid within the working fluid circuit 202. Accordingly, the pump portion 262 of the turbopump 260 may be disposed between the high pressure side and the low pressure side of the working fluid circuit 202. The pump inlet on the pump portion 262 is generally disposed in the low pressure side and the pump outlet on the pump portion 262 is generally disposed in the high pressure side. The drive turbine 264 of the turbopump 260 may be fluidly coupled to the working fluid circuit 202 downstream from the heat exchanger 150, and the pump portion 262 of the turbopump 260 is fluidly coupled to the working fluid circuit 202 upstream of the heat exchanger 120 for providing the heated working fluid to the turbopump 260 to move or otherwise power the drive turbine 264.

Further, in some embodiments, the pump portion 262 may include a pressure release passageway 300 disposed therein and coupled to a pressure release valve 302 via a pressure release line 304. The pressure release valve 302 may be coupled to the low pressure side of the working fluid circuit via line 306. In the illustrated embodiment, line 306 is coupled to the low pressure side at a location upstream of the condenser 274. However, it should be noted that in other embodiments, line 306 may be coupled to the low pressure side at any desired location, not limited to the location shown in FIG. 1.

The pressure release valve 302 may be positioned in an opened position, a closed position, or one or more intermediate positions between the opened position and the closed position. When positioned in the opened position, the pressure release valve 302 enables the release of pressure from the pump portion 262 via the pressure release passageway 300. This pressure is vented to the low pressure side of the working fluid circuit via line 306. However, when the pressure release valve 302 is positioned in the closed position, pressure from the pump portion 262 is substantially maintained in the pump portion 262 and is not vented to the low pressure side. In this way, the pressure release passageway 300 and the pressure release valve 302 may enable selective bleeding or venting of pressure from the pump portion 262 by selectively controlling the position of the pressure release valve 302, for example, via a control circuit located in the process control system 204.

By enabling the selective release of pressure via the pressure release passageway 300 and the pressure release valve 302, presently disclosed embodiments may enable a reduction or elimination of thrust loads generated by the pump portion 262. Further, certain embodiments may enable a reduction or elimination in a difference between a thrust load generated by the pump portion 262 and a thrust load generated by the drive turbine 264. For example, in some embodiments, the process control system 204 may monitor one or more detected pressures to determine whether there is a thrust imbalance in the system (e.g., between the thrust of the pump portion 262 and the thrust of the drive turbine 264) and, if an imbalance is determined to exist, may vent pressure via the pressure release passageway 300 by controlling the position of the pressure release valve 302. These and other features of embodiments of the pressure release and thrust balancing techniques disclosed herein are discussed in more detail below.

The start pump 280 has a pump portion 282 and a motor-drive portion 284. The start pump 280 is generally an electric motorized pump or a mechanical motorized pump, and may be a variable frequency driven pump. During operation, once a predetermined pressure, temperature, and/ or flowrate of the working fluid is obtained within the working fluid circuit 202, the start pump 280 may be taken offline, idled, or turned off, and the turbopump 260 may be utilized to circulate the working fluid during the electricity generation process. The working fluid enters each of the turbopump 260 and the start pump 280 from the low pressure side of the working fluid circuit 202 and exits each of the turbopump 260 and the start pump 280 from the high pressure side of the working fluid circuit 202.

The start pump 280 may be a motorized pump, such as an electric motorized pump, a mechanical motorized pump, or other type of pump. Generally, the start pump 280 may be a variable frequency motorized drive pump and contains a pump portion 282 and a motor-drive portion 284. The motor-drive portion 284 of the start pump 280 contains a motor and a drive including a driveshaft and gears. In some examples, the motor-drive portion 284 has a variable frequency drive, such that the speed of the motor may be regulated by the drive. The pump portion 282 of the start pump 280 is driven by the motor-drive portion 284 coupled thereto. The pump portion 282 has an inlet for receiving the working fluid from the low pressure side of the working fluid circuit 202, such as from the condenser 274 and/or the working fluid storage system 290. The pump portion 282 has an outlet for releasing the working fluid into the high pressure side of the working fluid circuit 202.

Start pump inlet valve 283 and start pump outlet valve 285 may be utilized to control the flow of the working fluid passing through the start pump 180. Start pump inlet valve 283 may be fluidly coupled to the low pressure side of the working fluid circuit 202 upstream of the pump portion 282 of the start pump 280 and may be utilized to control the flowrate of the working fluid entering the inlet of the pump portion 282. Start pump outlet valve 285 may be fluidly coupled to the high pressure side of the working fluid circuit 202 downstream from the pump portion 282 of the start pump 280 and may be utilized to control the flowrate of the working fluid exiting the outlet of the pump portion 282.

The drive turbine 264 of the turbopump 260 is driven by heated working fluid, such as the working fluid flowing from the heat exchanger 150. The drive turbine 264 is fluidly coupled to the high pressure side of the working fluid circuit 202 by an inlet configured to receive the working fluid from the high pressure side of the working fluid circuit 202, such as flowing from the heat exchanger 150. The drive turbine 264 is fluidly coupled to the low pressure side of the working fluid circuit 202 by an outlet configured to release the working fluid into the low pressure side of the working fluid circuit 202.

The pump portion 262 of the turbopump 260 is driven by the driveshaft 267 coupled to the drive turbine 264. The pump portion 262 of the turbopump 260 may be fluidly coupled to the low pressure side of the working fluid circuit 202 by an inlet configured to receive the working fluid from the low pressure side of the working fluid circuit 202. The inlet of the pump portion 262 is configured to receive the working fluid from the low pressure side of the working fluid circuit 202, such as from the condenser 274 and/or the working fluid storage system 290. Also, the pump portion 262 may be fluidly coupled to the high pressure side of the working fluid circuit 202 by an outlet configured to release the working fluid into the high pressure side of the working fluid circuit 202 and circulate the working fluid within the working fluid circuit 202.

In one configuration, the working fluid released from the outlet on the drive turbine 264 is returned into the working fluid circuit 202 downstream from the recuperator 216 and upstream of the recuperator 218. In one or more embodiments, the turbopump 260, including piping and valves, is optionally disposed on a turbo pump skid 266, as depicted in FIG. 1. The turbo pump skid 266 may be disposed on or adjacent to the main process skid 212.

A drive turbine bypass valve 265 is generally coupled between and in fluid communication with a fluid line extending from the inlet on the drive turbine 264 with a fluid line extending from the outlet on the drive turbine 264. The drive turbine bypass valve 265 is generally opened to bypass the turbopump 260 while using the start pump 280 during the initial stages of generating electricity with the heat engine system 200. Once a predetermined pressure and temperature of the working fluid is obtained within the working fluid circuit 202, the drive turbine bypass valve 265 is closed and the heated working fluid is flowed through the drive turbine 264 to start the turbopump 260.

A drive turbine throttle valve 263 may be coupled between and in fluid communication with a fluid line extending from the heat exchanger 150 to the inlet on the drive turbine 264 of the turbopump 260. The drive turbine throttle valve 263 is configured to modulate the flow of the heated working fluid into the drive turbine 264, which in turn may be utilized to adjust the flow of the working fluid throughout the working fluid circuit 202. Additionally, valve 293 may be utilized to provide back pressure for the drive turbine 264 of the turbopump 260.

A drive turbine attemperator valve 295 may be fluidly coupled to the working fluid circuit 202 via an attemperator bypass line 291 disposed between the outlet on the pump portion 262 of the turbopump 260 and the inlet on the drive turbine 264 and/or disposed between the outlet on the pump portion 282 of the start pump 280 and the inlet on the drive turbine 264. The attemperator bypass line 291 and the drive turbine attemperator valve 295 may be configured to flow the working fluid from the pump portion 262 or 282, around the recuperator 218 and the heat exchanger 150 to avoid such components, and to the drive turbine 264, such as during a warm-up or cool-down step of the turbopump 260. The attemperator bypass line 291 and the drive turbine attemperator valve 295 may be utilized to warm the working fluid with the drive turbine 264 while avoiding the thermal heat from the heat source stream 110 via the heat exchangers, such as the heat exchanger 150.

In another embodiment, the heat engine system 200 depicted in FIG. 1 has two pairs of turbine attemperator lines and valves, such that each pair of attemperator line and valve is fluidly coupled to the working fluid circuit 202 and disposed upstream of a respective turbine inlet, such as a drive turbine inlet and a power turbine inlet. The power turbine attemperator line 211 and the power turbine attemperator valve 223 are fluidly coupled to the working fluid circuit 202 and disposed upstream of a turbine inlet on the power turbine 264. Similarly, the drive turbine attemperator line 291 and the drive turbine attemperator valve 295 are fluidly coupled to the working fluid circuit 202 and disposed upstream of a turbine inlet on the turbopump 260.

The power turbine attemperator valve 223 and the drive turbine attemperator valve 295 may be utilized during a startup and/or shutdown procedure of the heat engine system 200 to control backpressure within the working fluid circuit 202. Also, the power turbine attemperator valve 223 and the drive turbine attemperator valve 295 may be utilized during a startup and/or shutdown procedure of the heat engine system 200 to cool hot flow of the working fluid from heat saturated heat exchangers, such as heat exchangers 120, 130, 140, and/or 150, coupled to and in thermal communication with working fluid circuit 202. The power turbine attemperator valve 223 may be modulated, adjusted, or otherwise controlled to manage the inlet temperature $T_1$ and/or the inlet pressure at (or upstream from) the inlet of the power turbine 228, and to cool the heated working fluid flowing from the outlet of the heat exchanger 120. Similarly, the drive turbine attemperator valve 295 may be modulated, adjusted, or otherwise controlled to manage the inlet temperature and/or the inlet pressure at (or upstream from) the inlet of the drive turbine 264, and to cool the heated working fluid flowing from the outlet of the heat exchanger 150.

In some embodiments, the drive turbine attemperator valve 295 may be modulated, adjusted, or otherwise controlled with the process control system 204 to decrease the inlet temperature of the drive turbine 264 by increasing the flowrate of the working fluid passing through the attemperator bypass line 291 and the drive turbine attemperator valve 295 and detecting a desirable value of the inlet temperature of the drive turbine 264 via the process control system 204. The desirable value is generally at or less than the predetermined threshold value of the inlet temperature of the drive turbine 264. In some examples, such as during startup of the turbopump 260, the desirable value for the inlet temperature upstream of the drive turbine 264 may be about 150° C. or less. In other examples, such as during an energy conversion process, the desirable value for the inlet temperature upstream of the drive turbine 264 may be about 170° C. or less, such as about 168° C. or less. The drive turbine 264 and/or components therein may be damaged if the inlet temperature is about 168° C. or greater.

In some embodiments, the working fluid may flow through the attemperator bypass line 291 and the drive turbine attemperator valve 295 to bypass the heat exchanger 150. This flow of the working fluid may be adjusted with throttle valve 263 to control the inlet temperature of the drive turbine 264. During the startup of the turbopump 260, the desirable value for the inlet temperature upstream of the drive turbine 264 may be about 150° C. or less. As power is increased, the inlet temperature upstream of the drive turbine 264 may be raised to optimize cycle efficiency and operability by reducing the flow through the attemperator bypass line 291. At full power, the inlet temperature upstream of the drive turbine 264 may be about 340° C. or greater and the flow of the working fluid bypassing the heat exchanger 150 through the attemperator bypass line 291 ceases, such as approaches about 0 kg/s, in some examples. Also, the pressure may range from about 14 MPa to about 23.4 MPa as the flow of the working fluid may be within a range from about 0 kg/s to about 32 kg/s depending on power level.

A control valve 261 may be disposed downstream from the outlet of the pump portion 262 of the turbopump 260 and the control valve 281 may be disposed downstream from the outlet of the pump portion 282 of the start pump 280. Control valves 261 and 281 are flow control safety valves and generally utilized to regulate the directional flow or to prohibit backflow of the working fluid within the working fluid circuit 202. Control valve 261 is configured to prevent the working fluid from flowing upstream towards or into the outlet of the pump portion 262 of the turbopump 260. Similarly, control valve 281 is configured to prevent the working fluid from flowing upstream towards or into the outlet of the pump portion 282 of the start pump 280.

The drive turbine throttle valve 263 is fluidly coupled to the working fluid circuit 202 upstream of the inlet of the drive turbine 264 of the turbopump 260 and configured to control a flow of the working fluid flowing into the drive turbine 264. The power turbine bypass valve 219 is fluidly coupled to the power turbine bypass line 208 and configured to modulate, adjust, or otherwise control the working fluid flowing through the power turbine bypass line 208 for controlling the flowrate of the working fluid entering the power turbine 228.

The power turbine bypass line 208 is fluidly coupled to the working fluid circuit 202 at a point upstream of an inlet of the power turbine 228 and at a point downstream from an outlet of the power turbine 228. The power turbine bypass line 208 is configured to flow the working fluid around and avoid the power turbine 228 when the power turbine bypass valve 219 is in an opened position. The flowrate and the pressure of the working fluid flowing into the power turbine 228 may be reduced or stopped by adjusting the power turbine bypass valve 219 to the opened position. Alternatively, the flowrate and the pressure of the working fluid flowing into the power turbine 228 may be increased or started by adjusting the power turbine bypass valve 219 to the closed position due to the backpressure formed through the power turbine bypass line 208.

The power turbine bypass valve 219 and the drive turbine throttle valve 263 may be independently controlled by the process control system 204 that is communicably connected, wired and/or wirelessly, with the power turbine bypass valve 219, the drive turbine throttle valve 263, and other parts of the heat engine system 200. The process control system 204 is operatively connected to the working fluid circuit 202 and a mass management system 270 and is enabled to monitor and control multiple process operation parameters of the heat engine system 200.

In one or more embodiments, the working fluid circuit 202 provides a bypass flowpath for the start pump 280 via the start pump bypass line 224 and a start pump bypass valve 254, as well as a bypass flowpath for the turbopump 260 via the turbo pump bypass line 226 and a turbo pump bypass valve 256. One end of the start pump bypass line 224 is fluidly coupled to an outlet of the pump portion 282 of the start pump 280, and the other end of the start pump bypass line 224 is fluidly coupled to a fluid line 229. Similarly, one end of a turbo pump bypass line 226 is fluidly coupled to an outlet of the pump portion 262 of the turbopump 260 and the other end of the turbo pump bypass line 226 is coupled to the start pump bypass line 224. In some configurations, the start pump bypass line 224 and the turbo pump bypass line 226 merge together as a single line upstream of coupling to a fluid line 229. The fluid line 229 extends between and is fluidly coupled to the recuperator 218 and the condenser 274. The start pump bypass valve 254 is disposed along the start pump bypass line 224 and fluidly coupled between the low pressure side and the high pressure side of the working fluid circuit 202 when in a closed position. Similarly, the turbo pump bypass valve 256 is disposed along the turbo pump bypass line 226 and fluidly coupled between the low pressure side and the high pressure side of the working fluid circuit 202 when in a closed position.

FIG. 1 further depicts a power turbine throttle valve 250 fluidly coupled to a bypass line 246 on the high pressure side of the working fluid circuit 202 and upstream of the heat exchanger 120, as disclosed by at least one embodiment described herein. The power turbine throttle valve 250 is fluidly coupled to the bypass line 246 and configured to modulate, adjust, or otherwise control the working fluid flowing through the bypass line 246 for controlling a general coarse flowrate of the working fluid within the working fluid circuit 202. The bypass line 246 is fluidly coupled to the working fluid circuit 202 at a point upstream of the valve 293 and at a point downstream from the pump portion 282 of the start pump 280 and/or the pump portion 262 of the turbopump 260.

Additionally, a power turbine trim valve 252 is fluidly coupled to a bypass line 248 on the high pressure side of the working fluid circuit 202 and upstream of the heat exchanger 150, as disclosed by another embodiment described herein. The power turbine trim valve 252 is fluidly coupled to the bypass line 248 and configured to modulate, adjust, or otherwise control the working fluid flowing through the bypass line 248 for controlling a fine flowrate of the working fluid within the working fluid circuit 202. The bypass line 248 is fluidly coupled to the bypass line 246 at a point upstream of the power turbine throttle valve 250 and at a point downstream from the power turbine throttle valve 250.

The heat engine system 200 further contains a drive turbine throttle valve 263 fluidly coupled to the working fluid circuit 202 upstream of the inlet of the drive turbine 264 of the turbopump 260 and configured to modulate a flow of the working fluid flowing into the drive turbine 264, a power turbine bypass line 208 fluidly coupled to the working fluid circuit 202 upstream of an inlet of the power turbine 228, fluidly coupled to the working fluid circuit 202 downstream from an outlet of the power turbine 228, and configured to flow the working fluid around and avoid the power turbine 228, a power turbine bypass valve 219 fluidly coupled to the power turbine bypass line 208 and configured to modulate a flow of the working fluid flowing through the power turbine bypass line 208 for controlling the flowrate of the working fluid entering the power turbine 228, and the process control system 204 operatively connected to the heat engine system 200, wherein the process control system 204 is configured to adjust the drive turbine throttle valve 263 and the power turbine bypass valve 219.

A heat exchanger bypass line 160 is fluidly coupled to a fluid line 131 of the working fluid circuit 202 upstream of the heat exchangers 120, 130, and/or 150 by a heat exchanger bypass valve 162, as illustrated in FIG. 1 and described in more detail below. The heat exchanger bypass valve 162 may be a solenoid valve, a hydraulic valve, an electric valve, a manual valve, or derivatives thereof. In many examples, the heat exchanger bypass valve 162 is a solenoid valve and configured to be controlled by the process control system 204. Regardless of the valve type, however, the valve may be controlled to route the working fluid in a manner that maintains the temperature of the working fluid at a level appropriate for the current operational state of the heat engine system. For example, the bypass valve may be regulated during startup to control the flow of the working fluid through a reduced quantity of heat exchangers to effectuate a lower working fluid temperature than would be achieved during a fully operational state when the working fluid is routed through all the heat exchangers.

In one or more embodiments, the working fluid circuit 202 provides release valves 213*a*, 213*b*, 213*c*, and 213*d*, as well as release outlets 214*a*, 214*b*, 214*c*, and 214*d*, respectively in fluid communication with each other. Generally, the release valves 213*a*, 213*b*, 213*c*, and 213*d* remain closed during the electricity generation process, but may be configured to automatically open to release an over-pressure at a predetermined value within the working fluid. Once the working fluid flows through the valve 213*a*, 213*b*, 213*c*, or 213*d*, the working fluid is vented through the respective release outlet 214*a*, 214*b*, 214*c*, or 214*d*. The release outlets 214*a*, 214*b*, 214*c*, and 214*d* may provide passage of the working fluid into the ambient surrounding atmosphere. Alternatively, the release outlets 214*a*, 214*b*, 214*c*, and 214*d* may provide passage of the working fluid into a recycling or reclamation step that generally includes capturing, condensing, and storing the working fluid.

The release valve 213*a* and the release outlet 214*a* are fluidly coupled to the working fluid circuit 202 at a point disposed between the heat exchanger 120 and the power turbine 228. The release valve 213*b* and the release outlet 214*b* are fluidly coupled to the working fluid circuit 202 at a point disposed between the heat exchanger 150 and the drive turbine 264 of the turbopump 260. The release valve 213*c* and the release outlet 214*c* are fluidly coupled to the working fluid circuit 202 via a bypass line that extends from a point between the valve 293 and the pump portion 262 of the turbopump 260 to a point on the turbo pump bypass line 226 between the turbo pump bypass valve 256 and the fluid line 229. The release valve 213*d* and the release outlet 214*d* are fluidly coupled to the working fluid circuit 202 at a point disposed between the recuperator 218 and the condenser 274.

A computer system 206, as part of the process control system 204, contains a multi-controller algorithm utilized to control the drive turbine throttle valve 263, the power turbine bypass valve 219, the heat exchanger bypass valve 162, the power turbine throttle valve 250, the power turbine trim valve 252, the pressure release valve 302, as well as other valves, pumps, and sensors within the heat engine system 200. In one embodiment, the process control system 204 is enabled to move, adjust, manipulate, or otherwise control the pressure release valve 302 for adjusting or controlling the thrust loads associated with operation of the turbopump 260. By controlling the position of the pressure release valve 302, the process control system 204 is also operable to regulate the pressure profiles present in the turbopump 260. For example, the control system 204 may regulate the pressure on one or more surfaces in the pump portion 262 by controlling the position of the pressure release valve 302, thus reducing or preventing the likelihood of damage to components of the turbopump 260 due to excessive thrust loads.

In some embodiments, the process control system 204 is communicably connected, wired and/or wirelessly, with numerous sets of sensors, valves, and pumps, in order to process the measured and reported temperatures, pressures, and mass flowrates of the working fluid at the designated points within the working fluid circuit 202. In response to these measured and/or reported parameters, the process control system 204 may be operable to selectively adjust the valves in accordance with a control program or algorithm, thereby maximizing operation of the heat engine system 200.

Further, in certain embodiments, the process control system 204, as well as any other controllers or processors disclosed herein, may include one or more non-transitory, tangible, machine-readable media, such as read-only memory (ROM), random access memory (RAM), solid state memory (e.g., flash memory), floppy diskettes, CD-ROMs, hard drives, universal serial bus (USB) drives, any other computer readable storage medium, or any combination thereof. The storage media may store encoded instructions, such as firmware, that may be executed by the process control system 204 to operate the logic or portions of the logic presented in the methods disclosed herein. For example, in certain embodiments, the heat engine system 200 may include computer code disposed on a computer-readable storage medium or a process controller that includes such a computer-readable storage medium. The computer code may include instructions for initiating a control function to alternate the position of the pressure release valve 302 when a thrust load imbalance is detected to vent pressure from the pump portion 262 to the low pressure side.

In some embodiments, the process control system 204 contains a control algorithm embedded in a computer system 206, which may include one or more control circuits, and the control algorithm contains a governing loop controller. The governing loop controller is generally utilized to adjust values throughout the working fluid circuit 202 for controlling the temperature, pressure, flowrate, and/or mass of the working fluid at specified points therein. In some embodiments, the governing loop controller may be configured to maintain desirable threshold values for the inlet temperature and the inlet pressure by modulating, adjusting, or otherwise controlling the drive turbine attemperator valve 295 and the drive turbine throttle valve 263. In other embodiments, the governing loop controller may be configured to maintain desirable threshold values for the inlet temperature by modulating, adjusting, or otherwise controlling the power turbine attemperator valve 223 and the power turbine throttle valve 250.

The process control system 204 may operate with the heat engine system 200 semi-passively with the aid of several sets of sensors. The first set of sensors may be arranged at or adjacent the suction inlet of the turbopump 260 and the start pump 280, and the second set of sensors may be arranged at or adjacent the outlet of the turbopump 260 and the start pump 280. The first and second sets of sensors monitor and report the pressure, temperature, mass flowrate, or other properties of the working fluid within the low and high pressure sides of the working fluid circuit 202 adjacent the turbopump 260 and the start pump 280. The third set of sensors may be arranged either inside or adjacent the working fluid storage vessel 292 of the working fluid storage system 290 to measure and report the pressure, temperature, mass flowrate, or other properties of the working fluid within the working fluid storage vessel 292. Additionally, an instrument air supply (not shown) may be coupled to sensors, devices, or other instruments within the heat engine system 200 including the mass management system 270 and/or other system components that may utilize a gaseous supply, such as nitrogen or air.

In some embodiments, the overall efficiency of the heat engine system 200 and the amount of power ultimately generated can be influenced by the inlet or suction pressure at the pump when the working fluid contains supercritical carbon dioxide. In order to minimize or otherwise regulate the suction pressure of the pump, the heat engine system 200 may incorporate the use of a mass management system ("MMS") 270. The mass management system 270 controls the inlet pressure of the start pump 280 by regulating the amount of working fluid entering and/or exiting the heat engine system 200 at strategic locations in the working fluid circuit 202, such as at tie-in points, inlets/outlets, valves, or conduits throughout the heat engine system 200. Consequently, the heat engine system 200 becomes more efficient by increasing the pressure ratio for the start pump 280 to a maximum possible extent.

The mass management system 270 contains at least one vessel or tank, such as a storage vessel (e.g., working fluid storage vessel 292), a fill vessel, and/or a mass control tank (e.g., mass control tank 286), fluidly coupled to the low pressure side of the working fluid circuit 202 via one or more valves, such as valve 287. The valves are moveable—as being partially opened, fully opened, and/or closed—to either remove working fluid from the working fluid circuit 202 or add working fluid to the working fluid circuit 202. Exemplary embodiments of the mass management system 270, and a range of variations thereof, are found in U.S. application Ser. No. 13/278,705, filed Oct. 21, 2011, published as U.S. Pub. No. 2012-0047892, and issued as U.S. Pat. No. 8,613,195, the contents of which are incorporated herein by reference to the extent consistent with the present disclosure. Briefly, however, the mass management system 270 may include a plurality of valves and/or connection points, each in fluid communication with the mass control tank 286. The valves may be characterized as termination points where the mass management system 270 is operatively connected to the heat engine system 200. The connection points and valves may be configured to provide the mass management system 270 with an outlet for flaring excess working fluid or pressure, or to provide the mass management system 270 with additional/supplemental working fluid from an external source, such as a fluid fill system.

In some embodiments, the mass control tank 286 may be configured as a localized storage tank for additional/supplemental working fluid that may be added to the heat engine system 200 when needed in order to regulate the pressure or temperature of the working fluid within the working fluid circuit 202 or otherwise supplement escaped working fluid. By controlling the valves, the mass management system 270 adds and/or removes working fluid mass to/from the heat engine system 200 with or without the need of a pump, thereby reducing system cost, complexity, and maintenance.

In some examples, a working fluid storage vessel 292 is part of a working fluid storage system 290 and is fluidly coupled to the working fluid circuit 202. At least one connection point, such as a working fluid feed 288, may be a fluid fill port for the working fluid storage vessel 292 of the working fluid storage system 290 and/or the mass management system 270. Additional or supplemental working fluid may be added to the mass management system 270 from an external source, such as a fluid fill system via the working fluid feed 288. Exemplary fluid fill systems are described and illustrated in U.S. Pat. No. 8,281,593, the contents of which are incorporated herein by reference to the extent consistent with the present disclosure.

In another embodiment described herein, bearing gas and seal gas may be supplied to the turbopump 260 or other devices contained within and/or utilized along with the heat engine system 200. One or multiple streams of bearing gas and/or seal gas may be derived from the working fluid within the working fluid circuit 202 and contain carbon dioxide in a gaseous, subcritical, or supercritical state.

In some examples, the bearing gas or fluid is flowed by the start pump 280, from a bearing gas supply **296*a* and/or a bearing gas supply 296*b*, into the working fluid circuit 202, through a bearing gas supply line (not shown), and to the bearings within the power generation system 220. In other examples, the bearing gas or fluid is flowed by the start pump 280, from the bearing gas supply 296*a* and/or the bearing gas supply 296*b*, from the working fluid circuit 202, through a bearing gas supply line (not shown), and to the bearings within the turbopump 260. The gas return 298** may be a connection point or valve that feeds into a gas system, such as a bearing gas, dry gas, seal gas, or other system.

At least one gas return 294 is generally coupled to a discharge, recapture, or return of bearing gas, seal gas, and other gases. The gas return 294 provides a feed stream into the working fluid circuit 202 of recycled, recaptured, or otherwise returned gases—generally derived from the working fluid. The gas return 294 is generally fluidly coupled to the working fluid circuit 202 upstream of the condenser 274 and downstream from the recuperator 218.

In another embodiment, the bearing gas supply source 141 is fluidly coupled to the bearing housing 268 of the turbopump 260 by the bearing gas supply line 142. The flow of the bearing gas or other gas into the bearing housing 268 may be controlled via the bearing gas supply valve 144 that is operatively coupled to the bearing gas supply line 142 and controlled by the process control system 204. The bearing gas or other gas generally flows from the bearing gas supply source 141, through the bearing housing 268 of the turbopump 260, and to the bearing gas recapture 148. The bearing gas recapture 148 is fluidly coupled to the bearing housing 268 by the bearing gas recapture line 146. The flow of the bearing gas or other gas from the bearing housing 268 and to bearing gas recapture 148 may be controlled via the bearing gas recapture valve 147 that is operatively coupled to the bearing gas recapture line 146 and controlled by the process control system 204.

In one or more embodiments, a working fluid storage vessel 292 may be fluidly coupled to the start pump 280 via the working fluid circuit 202 within the heat engine system 200. The working fluid storage vessel 292 and the working fluid circuit 202 contain the working fluid (e.g., carbon dioxide) and the working fluid circuit 202 fluidly has a high pressure side and a low pressure side.

The heat engine system 200 further contains a bearing housing, case, or other chamber, such as the bearing housings 238 and 268, fluidly coupled to and/or substantially encompassing or enclosing bearings within power generation system 220 and the turbine pump 260, respectively. In one embodiment, the turbopump 260 contains the drive turbine 264, the pump portion 262, and the bearing housing 268 fluidly coupled to and/or substantially encompassing or enclosing the bearings. The turbopump 260 further may contain a gearbox and/or a driveshaft 267 coupled between the drive turbine 264 and the pump portion 262. In another embodiment, the power generation system 220 contains the power turbine 228, the power generator 240, and the bearing housing 238 substantially encompassing or enclosing the bearings. The power generation system 220 further contains a gearbox 232 and a driveshaft 230 coupled between the power turbine 228 and the power generator 240.

Exemplary structures of the bearing housing 238 or 268 may completely or substantially encompass or enclose the bearings as well as all or part of turbines, generators, pumps, driveshafts, gearboxes, or other components shown or not shown for heat engine system 200. The bearing housing 238 or 268 may completely or partially include structures, chambers, cases, housings, such as turbine housings, generator housings, driveshaft housings, driveshafts that contain bearings, gearbox housings, derivatives thereof, or combinations thereof. FIGS. 1 and 2 depict the bearing housing 268 fluidly coupled to and/or containing all or a portion of the drive turbine 264, the pump portion 262, and the driveshaft 267 of the turbopump 260. In other examples, the housing of the drive turbine 264 and the housing of the pump portion 262 may be independently coupled to and/or form portions of the bearing housing 268. Similarly, the bearing housing 238 may be fluidly coupled to and/or contain all or a portion of the power turbine 228, the power generator 240, the driveshaft 230, and the gearbox 232 of the power generation system 220. In some examples, the housing of the power turbine 228 is coupled to and/or forms a portion of the bearing housing 238.

In one or more embodiments disclosed herein, the heat engine system 200 depicted in FIG. 1 is configured to monitor and maintain the working fluid within the low pressure side of the working fluid circuit 202 in a supercritical state during a startup procedure. The working fluid may be maintained in a supercritical state by adjusting or otherwise controlling a pump suction pressure upstream of an inlet on the pump portion 262 of the turbopump 260 via the process control system 204 operatively connected to the working fluid circuit 202.

The process control system 204 may be utilized to maintain, adjust, or otherwise control the pump suction pressure at or greater than the critical pressure of the working fluid during the startup procedure. The working fluid may be kept in a liquid-type or supercritical state and free or substantially free the gaseous state within the low pressure side of the working fluid circuit 202. Therefore, the pump system, including the turbopump 260 and/or the start pump 280, may avoid pump cavitation within the respective pump portions 262 and 282.

In some embodiments, the types of working fluid that may be circulated, flowed, or otherwise utilized in the working fluid circuit 202 of the heat engine system 200 include carbon oxides, hydrocarbons, alcohols, ketones, halogenated hydrocarbons, ammonia, amines, aqueous, or combinations thereof. Exemplary working fluids used in the heat engine system 200 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 202 of the heat engine system 200, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typically used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of supercritical carbon dioxide (sc-$CO_2$), subcritical carbon dioxide (sub-$CO_2$), and/or one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side, a low pressure side, and a working fluid circulated within the working fluid circuit 202. The use of the term "working fluid" is not intended to limit the state or phase of matter of the working fluid. For instance, the working fluid or portions of the working fluid may be in a fluid phase, a gas phase, a supercritical state, a subcritical state, or any other phase or state at any one or more points within the heat engine system 200 or thermodynamic cycle. In one or more embodiments, the working fluid is in a supercritical state over certain portions of the working fluid circuit 202 of the heat engine system 200 (e.g., a high pressure side) and in a subcritical state over other portions of the working fluid circuit 202 of the heat engine system 200 (e.g., a low pressure side).

In other embodiments, the entire thermodynamic cycle may be operated such that the working fluid is maintained in either a supercritical or subcritical state throughout the entire working fluid circuit 202 of the heat engine system 200. During different stages of operation, the high and low pressure sides the working fluid circuit 202 for the heat engine system 200 may contain the working fluid in a supercritical and/or subcritical state. For example, the high and low pressure sides of the working fluid circuit 202 may both contain the working fluid in a supercritical state during the startup procedure. However, once the system is synchronizing, load ramping, and/or fully loaded, the high pressure side of the working fluid circuit 202 may keep the working fluid in a supercritical state while the low pressure side the working fluid circuit 202 may be adjusted to contain the working fluid in a subcritical state or other liquid-type state.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less, or about 10 MPa or less. In some examples, the low pressure side of the working fluid circuit 202 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa, while the low pressure side of the working fluid circuit 202 may have a pressure within a range from about 8 MPa to about 11 MPa, and more narrowly within a range from about 10.3 MPa to about 11 MPa.

Referring generally to FIG. 1, the heat engine system 200 includes the power turbine 228 disposed between the high pressure side and the low pressure side of the working fluid circuit 202, disposed downstream from the heat exchanger 120, and fluidly coupled to and in thermal communication with the working fluid. The power turbine 228 is configured to convert a pressure drop in the working fluid to mechanical energy whereby the absorbed thermal energy of the working fluid is transformed to mechanical energy of the power turbine 228. Therefore, the power turbine 228 is an expansion device capable of transforming a pressurized fluid into mechanical energy, generally, transforming high temperature and pressure fluid into mechanical energy, such as rotating a shaft (e.g., the driveshaft 230).

The power turbine 228 may contain or be a turbine, a turbo, an expander, or another device for receiving and expanding the working fluid discharged from the heat exchanger 120. The power turbine 228 may have an axial construction or radial construction and may be a single-staged device or a multi-staged device. Exemplary turbine devices that may be utilized in power turbine 228 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 228.

The power turbine 228 is generally coupled to the power generator 240 by the driveshaft 230. A gearbox 232 is generally disposed between the power turbine 228 and the power generator 240 and adjacent or encompassing the driveshaft 230. The driveshaft 230 may be a single piece or may contain two or more pieces coupled together. In one example, as depicted in FIG. 2, a first segment of the driveshaft 230 extends from the power turbine 228 to the gearbox 232, a second segment of the driveshaft 230 extends from the gearbox 232 to the power generator 240, and multiple gears are disposed between and couple to the two segments of the driveshaft 230 within the gearbox 232.

In some configurations, the heat engine system 200 also provides for the delivery of a portion of the working fluid, seal gas, bearing gas, air, or other gas into a chamber or housing, such as a housing 238 within the power generation system 220 for purposes of cooling one or more parts of the power turbine 228. In other configurations, the driveshaft 230 includes a seal assembly (not shown) designed to prevent or capture any working fluid leakage from the power turbine 228. Additionally, a working fluid recycle system may be implemented along with the seal assembly to recycle seal gas back into the working fluid circuit 202 of the heat engine system 200.

The power generator 240 may be a generator, an alternator (e.g., permanent magnet alternator), or other device for generating electrical energy, such as transforming mechanical energy from the driveshaft 230 and the power turbine 228 to electrical energy. A power outlet 242 may be electrically coupled to the power generator 240 and configured to transfer the generated electrical energy from the power generator 240 and to an electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operably connected to the electrical grid 244 via the power outlet 242. In another example, the power generator 240 is an alternator and is electrically and operably connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resisters, storage devices, and other power electronic components and devices. In other embodiments, the power generator 240 may contain, be coupled with, or be other types of load receiving equipment, such as other types of electrical generation equipment, rotating equipment, a gearbox (e.g., gearbox 232), or other device configured to modify or convert the shaft work created by the power turbine 228. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 200 also provides for the delivery of a portion of the working fluid into a chamber or housing of the power turbine 228 for purposes of cooling one or more parts of the power turbine 228. In one embodiment, due to the potential need for dynamic pressure balancing within the power generator 240, the selection of the site within the heat engine system 200 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet of the power turbine 228. The working fluid is conditioned to be at a desired temperature and pressure prior to being introduced into the power turbine 228. A portion of the working fluid, such as the spent working fluid, exits the power turbine 228 at an outlet of the power turbine 228 and is directed to one or more heat exchangers or recuperators, such as recuperators 216 and 218. The recuperators 216 and 218 may be fluidly coupled to the working fluid circuit 202 in series with each other. The recuperators 216 and 218 are operative to transfer thermal energy between the high pressure side and the low pressure side of the working fluid circuit 202.

In one embodiment, the recuperator 216 is fluidly coupled to the low pressure side of the working fluid circuit 202, disposed downstream from a working fluid outlet on the power turbine 228, and disposed upstream of the recuperator 218 and/or the condenser 274. The recuperator 216 is configured to remove at least a portion of thermal energy from the working fluid discharged from the power turbine 228. In addition, the recuperator 216 is also fluidly coupled to the high pressure side of the working fluid circuit 202, disposed upstream of the heat exchanger 120 and/or a working fluid inlet on the power turbine 228, and disposed downstream from the heat exchanger 130. The recuperator 216 is configured to increase the amount of thermal energy in the working fluid prior to flowing into the heat exchanger 120 and/or the power turbine 228. Therefore, the recuperator 216 is operative to transfer thermal energy between the high pressure side and the low pressure side of the working fluid circuit 202. In some examples, the recuperator 216 may be a heat exchanger configured to cool the low pressurized working fluid discharged or downstream from the power turbine 228 while heating the high pressurized working fluid entering into or upstream of the heat exchanger 120 and/or the power turbine 228.

Similarly, in another embodiment, the recuperator 218 is fluidly coupled to the low pressure side of the working fluid circuit 202, disposed downstream from a working fluid outlet on the power turbine 228 and/or the recuperator 216, and disposed upstream of the condenser 274. The recuperator 218 is configured to remove at least a portion of thermal energy from the working fluid discharged from the power turbine 228 and/or the recuperator 216. In addition, the recuperator 218 is also fluidly coupled to the high pressure side of the working fluid circuit 202, disposed upstream of the heat exchanger 150 and/or a working fluid inlet on a drive turbine 264 of turbopump 260, and disposed downstream from a working fluid outlet on the pump portion 262 of turbopump 260. The recuperator 218 is configured to increase the amount of thermal energy in the working fluid prior to flowing into the heat exchanger 150 and/or the drive turbine 264. Therefore, the recuperator 218 is operative to transfer thermal energy between the high pressure side and the low pressure side of the working fluid circuit 202. In some examples, the recuperator 218 may be a heat exchanger configured to cool the low pressurized working fluid discharged or downstream from the power turbine 228 and/or the recuperator 216 while heating the high pressurized working fluid entering into or upstream of the heat exchanger 150 and/or the drive turbine 264.

A cooler or a condenser 274 may be fluidly coupled to and in thermal communication with the low pressure side of the working fluid circuit 202 and may be configured or operative to control a temperature of the working fluid in the low pressure side of the working fluid circuit 202. The condenser 274 may be disposed downstream from the recuperators 216 and 218 and upstream of the start pump 280 and the turbopump 260. The condenser 274 receives the cooled working fluid from the recuperator 218 and further cools and/or condenses the working fluid which may be recirculated throughout the working fluid circuit 202. In many examples, the condenser 274 is a cooler and may be configured to control a temperature of the working fluid in the low pressure side of the working fluid circuit 202 by transferring thermal energy from the working fluid in the low pressure side to a cooling loop or system outside of the working fluid circuit 202.

A cooling media or fluid is generally utilized in the cooling loop or system by the condenser 274 for cooling the working fluid and removing thermal energy outside of the working fluid circuit 202. The cooling media or fluid flows through, over, or around while in thermal communication with the condenser 274. Thermal energy in the working fluid is transferred to the cooling fluid via the condenser 274. Therefore, the cooling fluid is in thermal communication with the working fluid circuit 202, but not fluidly coupled to the working fluid circuit 202. The condenser 274 may be fluidly coupled to the working fluid circuit 202 and independently fluidly coupled to the cooling fluid. The cooling fluid may contain one or multiple compounds and may be in one or multiple states of matter. The cooling fluid may be a media or fluid in a gaseous state, a liquid state, a subcritical state, a supercritical state, a suspension, a solution, derivatives thereof, or combinations thereof.

In many examples, the condenser 274 is generally fluidly coupled to a cooling loop or system (not shown) that receives the cooling fluid from a cooling fluid return 278*a* and returns the warmed cooling fluid to the cooling loop or system via a cooling fluid supply 278*b*. The cooling fluid may be water, carbon dioxide, or other aqueous and/or organic fluids (e.g., alcohols and/or glycols), air or other gases, or various mixtures thereof that is maintained at a lower temperature than the temperature of the working fluid. In other examples, the cooling media or fluid contains air or another gas exposed to the condenser 274, such as an air steam blown by a motorized fan or blower. A filter 276 may be disposed along and in fluid communication with the cooling fluid line at a point downstream from the cooling fluid supply 278*b* and upstream of the condenser 274. In some examples, the filter 276 may be fluidly coupled to the cooling fluid line within the process system 210.

Figure 2A:
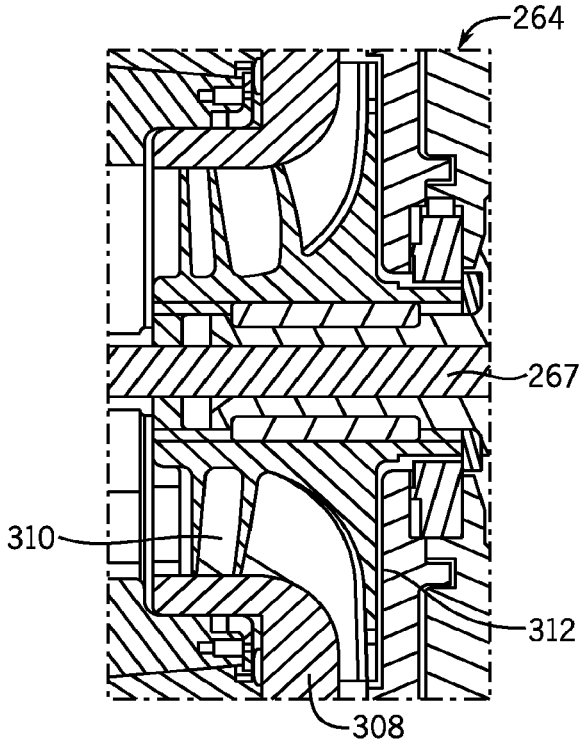
FIG. 2A illustrates a cross sectional view of a back portion of a drive turbine, according to one or more embodiments disclosed herein.
Figure 2B:
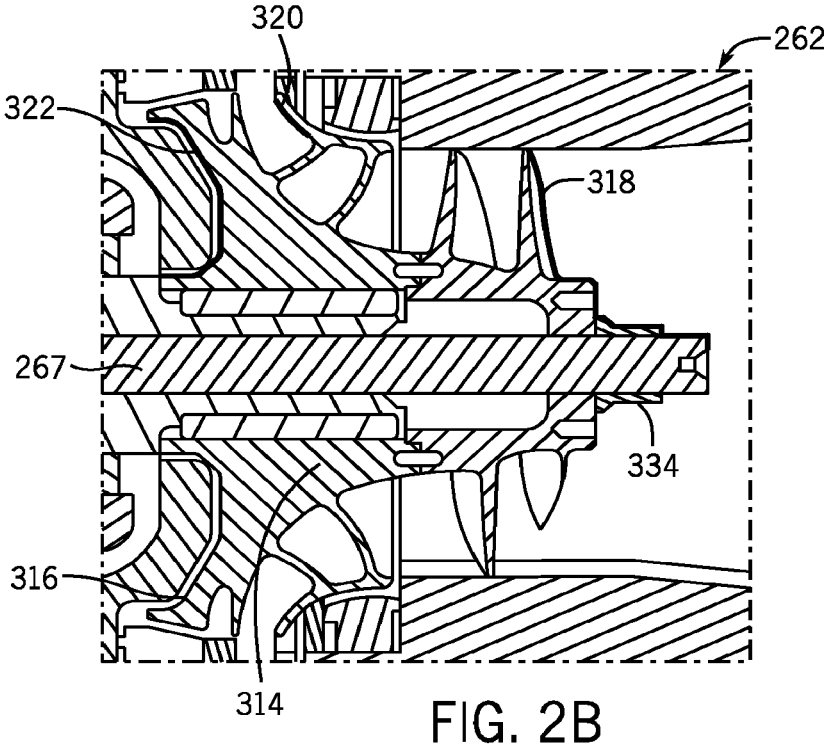
FIG. 2B illustrates a cross sectional view of a portion of a pump, according to one or more embodiments disclosed herein.

Turning now to FIGS. 2A and 2B, illustrated therein are cross sectional views of embodiments of the pump portion 262 and the drive turbine 264 of the turbopump 260 that are configured to be coupled via driveshaft 267. In the illustrated embodiment, the drive turbine 264 includes a housing 308 and a turbine wheel 310 disposed within the housing 308. Further, the turbine wheel 310 shown in FIG. 2A is disposed about the driveshaft 267 and includes a back side 312. However, it should be noted that in other embodiments, the drive turbine 264 is subject to implementation-specific variations and is not limited to those shown herein.

Similarly, the pump portion 262 shown in FIG. 2B includes a housing 335 enclosing a cavity 337 and an impeller 314 disposed about the driveshaft 267 and having a rear face 316. In some configurations, the rear face 316 of the impeller 314 of the pump portion 262 may face the back side 312 of the turbine wheel 310. During operation, the drive turbine 264 may be powered by heated working fluid, for example, from a point downstream of the heat exchanger 150, and the turbine wheel 310 rotates to generate power that drives the impeller 314 of the pump portion 262. The rotation of the impeller 314 of the pump portion 262 circulates the working fluid through the working fluid circuit 202. However, in embodiments in which the back side 312 of the turbine wheel 310 faces the rear face 316 of the impeller 314 (e.g., in a turbocharger), it may be desirable to balance the thrust generated by the turbine wheel 310 with the thrust generated by the impeller 314 (or other compressor wheel in other implementations), particularly in implementations utilizing supercritical carbon dioxide in which the machine power density, pressure rise, and rotating speeds during operation are such that standard thrust bearing design techniques may not provide sufficient load capacity.

The high thrust loads that may be present in the turbopump 260 may result in the development of pressure on the pump portion 262 and/or the turbine wheel 310, and the pressures existing in the system may be a function of the speeds at which the turbopump 260 is operating. For example, as illustrated in FIG. 2B, in some embodiments, the pressure may be exhibited as gradients 318, 320, and 322 along the front and rear of the impeller 314 and may result in increasing thrust loads as the speed at which the impeller 314 rotates is increased during operation. Additionally, increased axial loads may be generated by the momentum of the working fluid entering and exiting the turbopump 260. Accordingly, presently disclosed embodiments may provide systems and methods that enable a reduction in the thrust loads generated by the pump portion 262 and/or balancing of the thrust loads generated by the drive turbine 264 and the pump portion 262. For example, in some embodiments, there may be a substantial difference in the pressures present on the front side of the pump portion 262 as compared to the pressure on the rear face 316 of the impeller 314, and difficulty may arise in attempts to reduce the pressure on the rear face 316 to compensate for the pressures on the front side. Therefore, certain presently disclosed embodiments may enable bleeding or release of pressure from a location proximate to the rear face 316 of the impeller 314.

Figure 3:
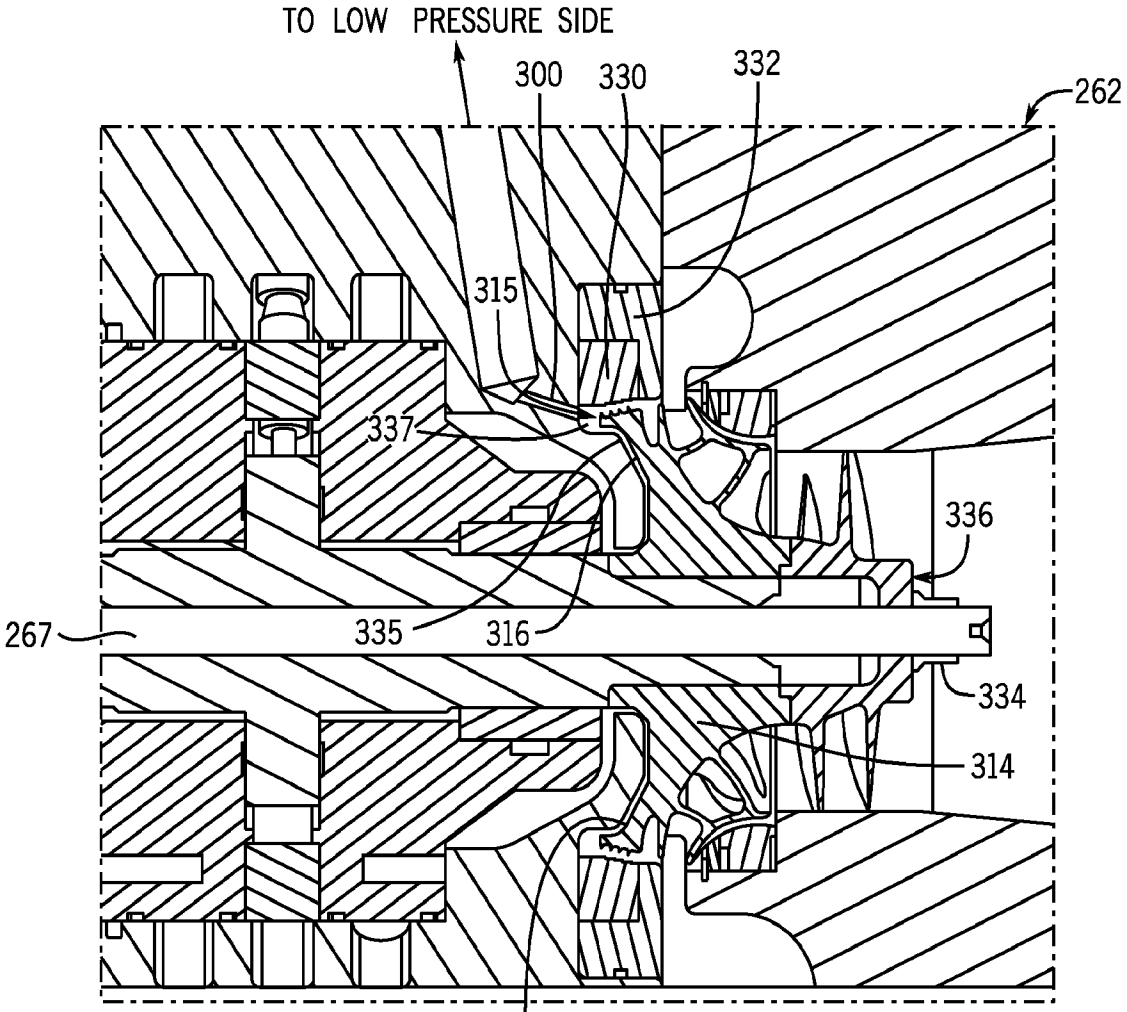
FIG. 3 illustrates a cross sectional view of a pump having a pressure release passageway, according to one or more embodiments disclosed herein.

For example, in one embodiment, as illustrated in FIG. 3, the pressure release passageway 300 may be provided at or near the rear face 316 of the impeller 314. More particularly, in one or more embodiments, the pressure release passageway 300 may be provided at or near the rear face 316 proximate a tip 315 of the impeller 314. As such, the pressure release passageway 300 is fluidly coupled to a cavity 337 generally disposed between the rear face 316 of the impeller 314 and the housing 335. During operation, the pressure release passageway 300 may be utilized to vent pressure from the cavity 337, for example, via selective control of the positioning of the pressure release valve 302, to reduce the thrust generated during operation of the turbopump 260. Further, in some embodiments, the pressure release passageway 300 may be fluidly coupled to the low pressure side of the working fluid circuit 202, for example, via lines 304 and 306 shown in FIG. 1, for the purpose of venting the pressure from the cavity 337 to the low pressure side of the working fluid circuit 202. However, in other embodiments, the pressure release passageway 300 may be coupled to any desired location within the working fluid circuit 202 or outside of the working fluid circuit 202, depending on implementation-specific considerations.

The pressure release passageway 300 may be disposed in the pump portion 262 and formed in a variety of suitable ways, depending on the given application. In some embodiments, the pressure release passageway 300 may be integrally formed in the pump portion 262, for instance, during manufacturing, or may be provided in the pump portion 262 at the location of use. For example, in one embodiment, the pressure release passageway 300 may be drilled into the housing 335 of the pump portion 262. In other embodiments, the pressure release passageway 300 may be drilled or otherwise formed in the housing 335 of the pump portion 262 at another suitable location. For example, the location of the pressure release passageway 300 may be chosen such that the need for the pressure release valve 302 is reduced or eliminated. That is, if the pressure release passageway 300 is suitably positioned, for example, prior to testing or operation of the pump portion 262, the thrust load may be directly measured, and the need for the pressure release valve 302 may be eliminated in some embodiments.

In the illustrated embodiment, the pressure release passageway 300 is proximate to a labyrinth seal 330 surrounded by a retainer 332. In certain embodiments, the labyrinth seal 330 may be formed from a material that is softer than the material used to form the impeller 314. For example, in one embodiment, the labyrinth seal 330 may be formed from plastic. Further, the retainer 332 may be formed from a material that is harder than the material used for the labyrinth seal 330. This may be desirable in embodiments in which the working fluid is supercritical carbon dioxide because the working fluid may be abrasive, resulting in greater wear to retainers of a softer material. In some embodiments, an additional labyrinth seal 334 may also be provided at or near a nose portion 336 of the impeller 314.

During operation, as the impeller 314 rotates to pump the working fluid through the working fluid circuit 202, pressure accumulates on the front and rear faces of the impeller 314, and an imbalance in the pressures on the front and rear surfaces may lead to axial loads. Additionally, in embodiments in which the impeller 314 of the pump portion 262 is opposed by the turbine wheel 310, the drive turbine 264 also generates axial loads. Further, as the speed of the impeller 314 and/or the turbine wheel 310 increases, the generated thrust loads increase. Therefore, presently disclosed embodiments may provide a way to release pressure via the pressure release passageway 300 to balance at least a portion of the generated thrust loads. For example, in one embodiment, the thrust loads generated within the pump portion 262 may be balanced (e.g., by balancing the pressures on the front and rear surfaces of the impeller 314) independent of the drive turbine 264. However, in other embodiments, the thrust loads of the entire turbopump 260, for example an assembly forming the turbopump 260 as discussed above, may be balanced. For instance, the thrust loads generated by the drive turbine 264 may be balanced compared to the thrust loads generated by the pump portion 262. However, it should be noted that in many applications, the operating variability associated with the turbomachinery may be such that netting zero thrust is substantially unattainable throughout operation. Accordingly, in certain embodiments, balancing the thrust loads may include maintaining a difference between the thrust loads being balanced within a certain range. In such embodiments, the process control system 204 may operate to control the release of pressure via the pressure release passageway 300 to minimize the thrust in the system, thereby minimizing the thrust bearing load capacity and increasing system efficiency.

Figure 4:
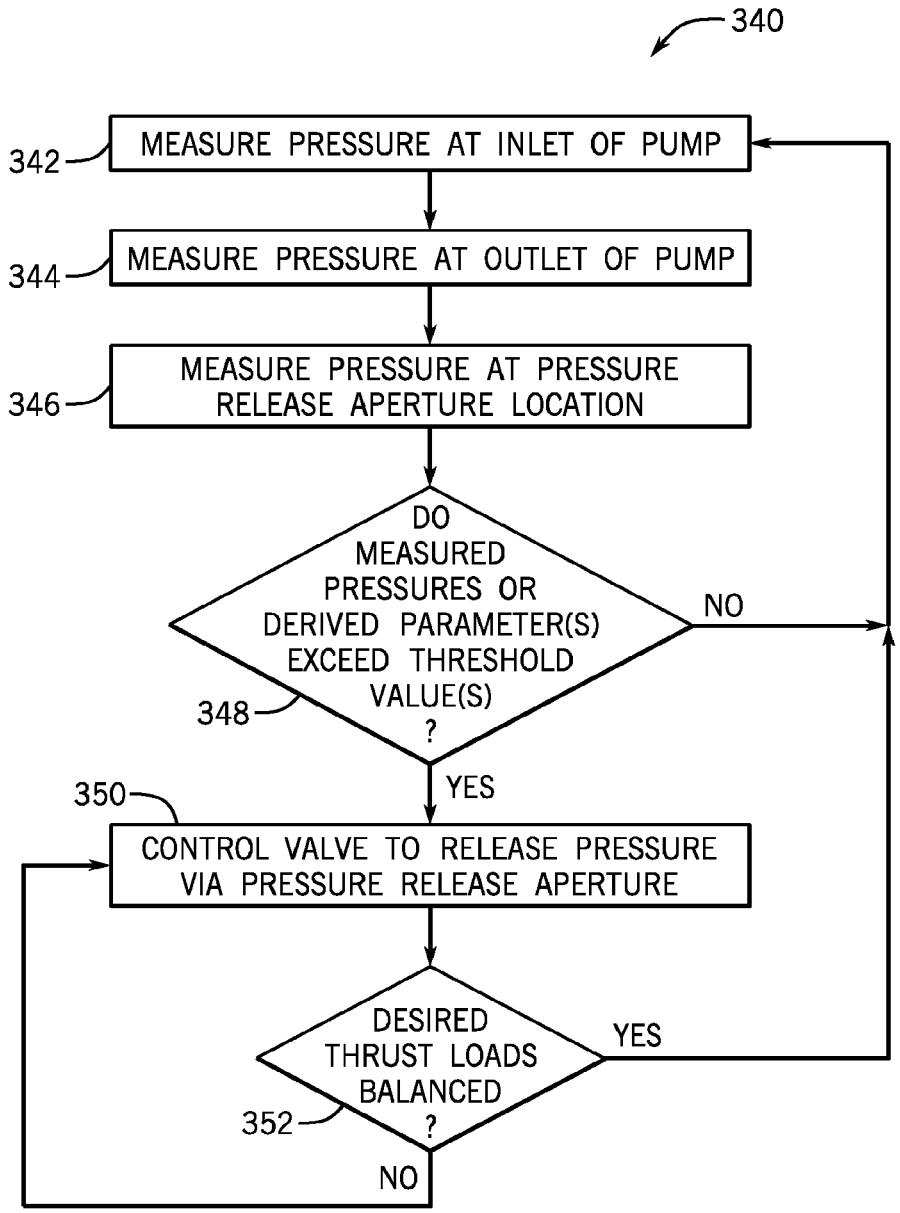
FIG. 4 is a flow chart illustrating a method for balancing one or more thrust loads in a heat engine system, according to one or more embodiments disclosed herein.

FIG. 4 is a flow chart illustrating an embodiment of a thrust balancing method 340. In the illustrated embodiment, the thrust balancing method 340 includes measuring a pressure at an inlet of the pump portion (block 342), measuring a pressure at an outlet of the pump portion (block 344), and measuring a pressure at a pressure release passageway location defined by or formed in a housing of the pump portion (block 346). However, in other embodiments, any desired number of pressures at a variety of suitable locations may be measured. For example, the pressures may be measured at the inlet and the outlet of the turbopump 260 or at the inlet and the outlet of the pump portion 262, depending on the given application and the thrusts that are desired to be balanced. Once measured, the pressures may be directly or indirectly utilized for the purpose of balancing one or more thrust loads, and the measured values may be communicated as first, second, and third data sets to the process control system 204. To that end, the thrust balancing method 340 also includes determining whether the measured pressures, or one or more parameters derived from the measured pressures, exceed one or more threshold values (block 348). For instance, the measured pressures may be used by the process control system 204 to derive pressure profiles or other parameters that correspond to the thrust loads in the system. Further, in some embodiments, the threshold values to which the measured or derived values are compared may be ranges of allowable values, rather than a single fixed value, to accommodate the operating variability of the turbomachinery in the given application.

If the measured or derived values exceed the threshold values, the process control system 204 implementing the thrust balancing method 340 proceeds by controlling a valve to release pressure via a pressure release passageway (block 350). For example, the process control system 204 may control the pressure release valve 302 to release pressure via the pressure release passageway 300 disposed in the pump portion 262 into the low pressure side of the working fluid circuit 202. The process control system 204 implementing the thrust balancing method 340 then proceeds by checking if the thrust loads have been balanced (block 352) and releasing additional pressure if the thrust loads have not been balanced (block 350). Here again, it should be noted that balancing the thrust loads may include keeping a difference in thrust loads and/or pressures in the system within a predetermined range.

It is to be understood that the present disclosure describes several exemplary embodiments for implementing different features, structures, or functions of the invention. Exemplary embodiments of components, arrangements, and configurations are described herein to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the present disclosure and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the present disclosure and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A turbopump system, comprising:

a pump portion comprising a housing and an impeller disposed in an impeller cavity defined by the housing, the housing further defining a pressure release passageway extending from a portion of the impeller cavity proximal a rear face of the impeller and configured to enable release of pressure from the pump portion, wherein the pump portion is disposed between a high pressure side and a low pressure side of a working fluid circuit;

a drive turbine coupled to the pump portion and configured to drive the pump portion to enable the pump portion to circulate a working fluid through the working fluid circuit; and a pressure release valve fluidly coupled to the pressure release passageway and configured to be positioned in an opened position to enable pressure to be released through the pressure release passageway and in a closed position to disable pressure from being released through the pressure release passageway, and further comprising:

a first set of sensors arranged to provided first data corresponding to a measured pressure at an inlet of the pump portion, the impeller rear face opposing the inlet;

a second set of sensors arranged to provide second data corresponding to a measured pressure at an outlet of the pump portion;

a third set of sensors arranged to provide third data corresponding to a measured pressure at the pressure release passageway defined in the housing;

a controller configured to determine, based on a combination of the first data, the second data and the third data, whether a thrust load generated by the pump exceeds a predetermined threshold; and the controller configured to actuate the pressure release valve fluidly coupled to the pressure release passageway to an opened position to release pressure from the pump when the thrust load exceeds the predetermined threshold; and wherein the controller is further configured to selectively position the pressure release valve to the opened position when a difference between a thrust load present on the housing of the pump portion and a second thrust load present on a housing of a turbine wheel exceeds a predetermined threshold.

2. The system of claim 1, comprising a controller configured to control the pressure release valve to selectively position the pressure release valve between the opened position, the closed position, and a plurality of partially opened positions between the opened position and the closed position.

3. The system of claim 1, wherein the controller is configured to selectively position the pressure release valve to the opened position or to a partially opened position when a parameter indicative of a thrust load generated by the pump portion exceeds a threshold value.

* * * * *